US010983472B2

(12) United States Patent
Inoue et al.

(10) Patent No.: US 10,983,472 B2
(45) Date of Patent: Apr. 20, 2021

(54) IMAGE FORMING SYSTEM INCLUDING A PLURALITY OF RECORDING MEDIUM COOLING APPARATUSES AND AN UNCURLING APPARATUS

(71) Applicant: CANON KABUSHIKI KAISHA, Tokyo (JP)

(72) Inventors: Yuki Inoue, Toride (JP); Atsushi Yoshida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/874,757

(22) Filed: May 15, 2020

(65) Prior Publication Data

US 2020/0363764 A1 Nov. 19, 2020

(30) Foreign Application Priority Data

May 17, 2019 (JP) ..... JP2019-093405

(51) Int. Cl.
*G03G 15/00* (2006.01)
*G03G 15/20* (2006.01)
*G03G 15/23* (2006.01)

(52) U.S. Cl.
CPC ..... *G03G 15/6573* (2013.01); *G03G 15/2021* (2013.01); *G03G 15/235* (2013.01); *G03G 15/6555* (2013.01); *G03G 15/6576* (2013.01); *G03G 2215/00662* (2013.01); *G03G 2215/00704* (2013.01)

(58) Field of Classification Search
CPC ..... G03G 15/2021; G03G 15/235; G03G 15/6573; G03G 15/6576; G03G 2215/00426; G03G 2215/00421; G03G 2215/00662; G03G 2215/00704
USPC ..... 399/401, 405, 406
See application file for complete search history.

(56) References Cited

U.S. PATENT DOCUMENTS 8,600,285 B2 * 12/2013 Makinodan ..... G03G 15/6576 399/406
2005/0063747 A1 * 3/2005 Ushio ..... G03G 15/6576 399/406
2011/0229169 A1 * 9/2011 Onodera ..... B65H 29/60 399/45
2012/0315070 A1 * 12/2012 Harashima ..... G03G 15/235 399/341
2016/0103412 A1 * 4/2016 Sato ..... G03G 15/6573 399/406

(Continued)

FOREIGN PATENT DOCUMENTS

JP H04-260065 A 9/1992
JP 04335688 A * 11/1992

(Continued)

*Primary Examiner* — Robert B Beatty
(74) *Attorney, Agent, or Firm* — Venable LLP

(57) ABSTRACT

In a feeding direction of a recording material, a recording material cooling device is provided downstream of a fixing device, a curl reducing device is provided downstream of the recording material cooling device, and another recording material cooling device is provided downstream of the curl reducing device. By this configuration, occurrence of image defect by the recording material cooling device during the feeding of the recording material can be suppressed, and the curling of the recording material can be reduced after the recording material is cooled.

8 Claims, 6 Drawing Sheets

(56) References Cited

U.S. PATENT DOCUMENTS

2017/0139374 A1* 5/2017 Yokota ..... G03G 21/206

FOREIGN PATENT DOCUMENTS

| | | | | |
|---|---|---|---|---|
| JP | 2003-12215 | A | | 1/2003 |
| JP | 2003066744 | A | * | 3/2003 |
| JP | 2007-119109 | A | | 5/2007 |
| JP | 2012194246 | A | * | 10/2012 |
| JP | 2017-90831 | A | | 5/2017 |
| JP | 2017109843 | A | * | 6/2017 |

* cited by examiner

IMAGE FORMING SYSTEM INCLUDING A PLURALITY OF RECORDING MEDIUM COOLING APPARATUSES AND AN UNCURLING APPARATUS

CROSS-REFERENCE TO RELATED APPLICATION

This application claims the benefit of Japanese Patent Application No. 2019-093405 filed on May 17, 2019, which is hereby incorporated by reference herein in its entirety.

FIELD OF THE INVENTION AND RELATED ART

The present invention relates to an image formation system having an electrophotographic image forming apparatus, such as a printer, a copying machine, a facsimileing machine, and a multifunction image forming machine.

An electrophotographic image forming apparatus fixes a toner image formed on a sheet of recording medium such as paper to the sheet of recording medium by heating and pressing the toner image, using a fixing apparatus. During the toner image fixation, the sheet is heated. Therefore, as the sheet is conveyed out of a fixing apparatus, the sheet is likely to be higher in temperature than it was before the fixation. Further, if the sheet is discharged into a delivery area while its temperature is higher than a preset level after the fixation of the toner image, it is possible that, as the sheet is conveyed, the toner image will become nonuniform in gloss and/or that, as multiple sheets of recording medium are accumulated in a delivery area, they will to adhere to each other because of the toner. Thus, some image forming apparatuses are equipped with a cooling apparatus for cooling a sheet of recording medium as the sheet comes out of the fixing apparatus to cool the sheet and reduce the temperature of the toner image below a preset level to prevent these problems of the toner image becoming nonuniform in gloss, and/or sheets of recording medium sticking to each other in the delivery area (Japanese Laid-open Patent Application No. H04-260065).

Further, as a sheet of recording medium is conveyed through the fixing apparatus, it is heated. Therefore, as the sheet comes out of the fixing apparatus, it tends to curl. A curled sheet of recording medium likely has a reduced ability to be conveyed or stacked. Thus, there has been proposed an image forming apparatus equipped with an uncurling apparatus for uncurling a curled sheet of recording medium (Japanese Laid-open Patent Application No. 2003-12215).

By the way, if a sheet of recording medium is conveyed to an uncurling apparatus while remaining higher in temperature than a preset level, it is possible that the toner on the sheet of recording medium will adhere to the uncurling apparatus. Therefore, not only is it possible for the toner image to become nonuniform in gloss, but also the uncurling apparatus will be soiled by the toner. Therefore, a sheet of recording medium has to be cooled by a cooling apparatus before it is uncurled by an uncurling apparatus. However, if a sheet of recording medium is cooled by a cooling apparatus before it is uncurled, it is possible overcool the sheet such that the sheet is not satisfactorily uncurled, although it depends on recording medium type. Thus, there has long been desired a system which can properly cool a sheet of recording medium and also properly uncurl the sheet. However, such a system has not been proposed so far.

The present invention was made in consideration of the above described problems. Thus, the primary object of the present invention is to provide an image forming apparatus which is provided with a cooling apparatus and an uncurling apparatus, and is capable of satisfactorily cooling a sheet of recording medium, and also, satisfactorily uncurling the sheet of recording medium.

SUMMARY OF THE INVENTION

In one aspect, the present invention provides an image forming system including a main assembly, an image forming unit, a fixing device, a first cooling device, a curl reducing device, and a second cooling device. The image forming unit is configured to form of a toner image on a recording material. The fixing device is configured to heat the recording material carrying the toner image formed by said image forming unit to fix the toner image on the recording material. The first cooling device is capable of cooling the recording material that has been passed through said fixing device. The curl reducing device is configured to nip and feed the recording material that has been passed through said first cooling device and to reduce curl of the recording material. The second cooling device is capable of cooling the recording material that has been passed through said curl reducing device.

Further features of the present invention will become apparent from the following description of exemplary embodiments with reference to the attached drawings.

Figure 4:
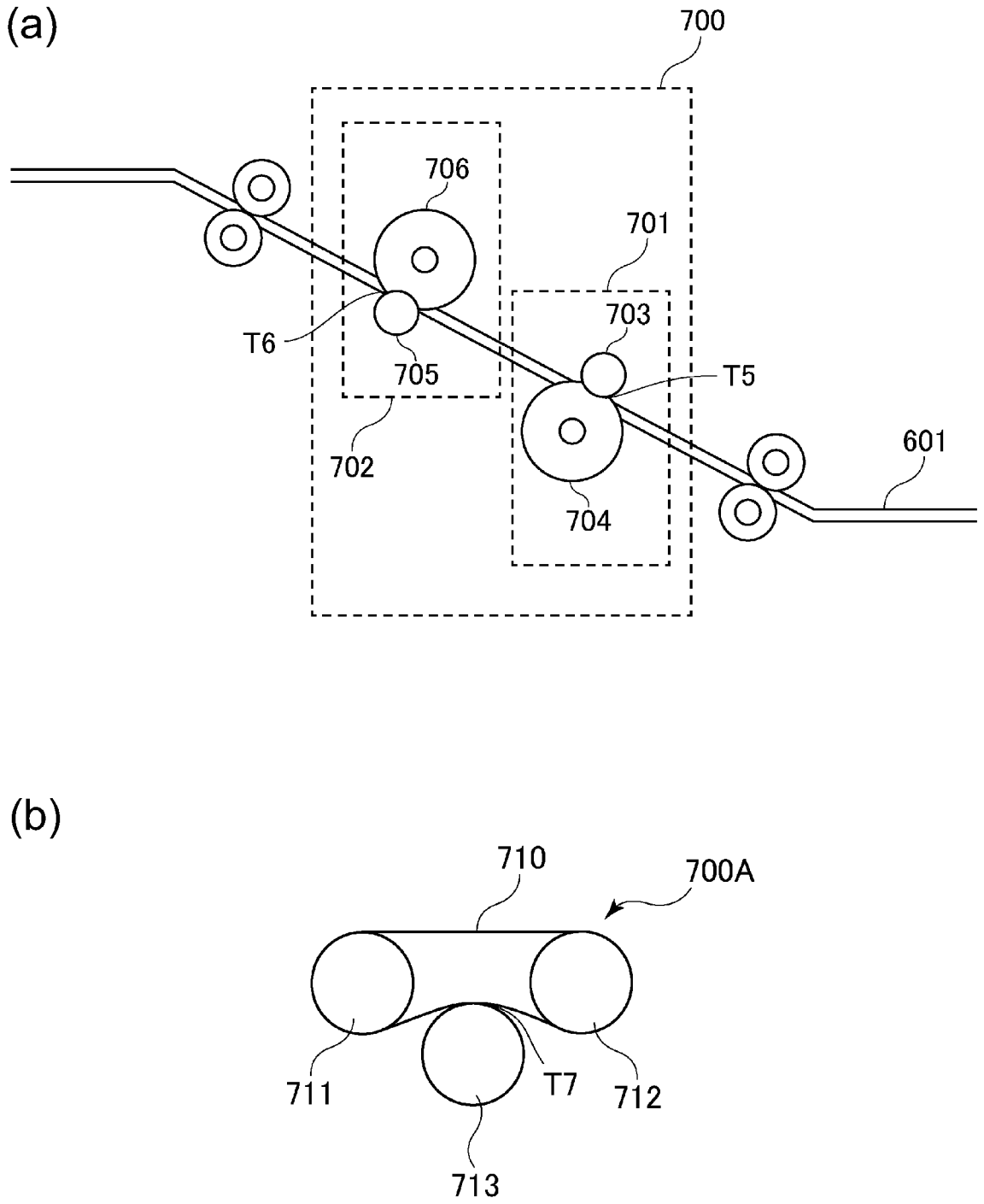

Part (a) of FIG. 4 is a schematic sectional view of an uncurling apparatus which uses two pairs of rollers.

Part (b) of FIG. 4 is a schematic sectional view of an uncurling apparatus which uses a combination of rollers and a belt.

Figure 5:
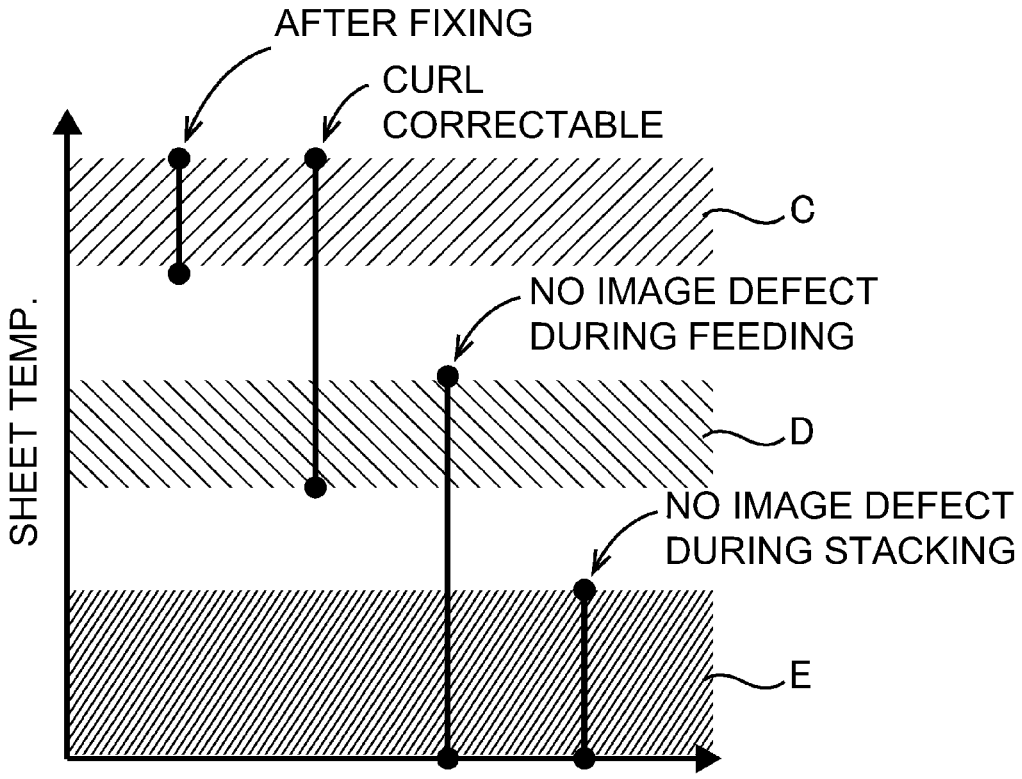

FIG. 5 is a graph which describes the temperature distribution of a sheet of recording medium.

Figure 6:
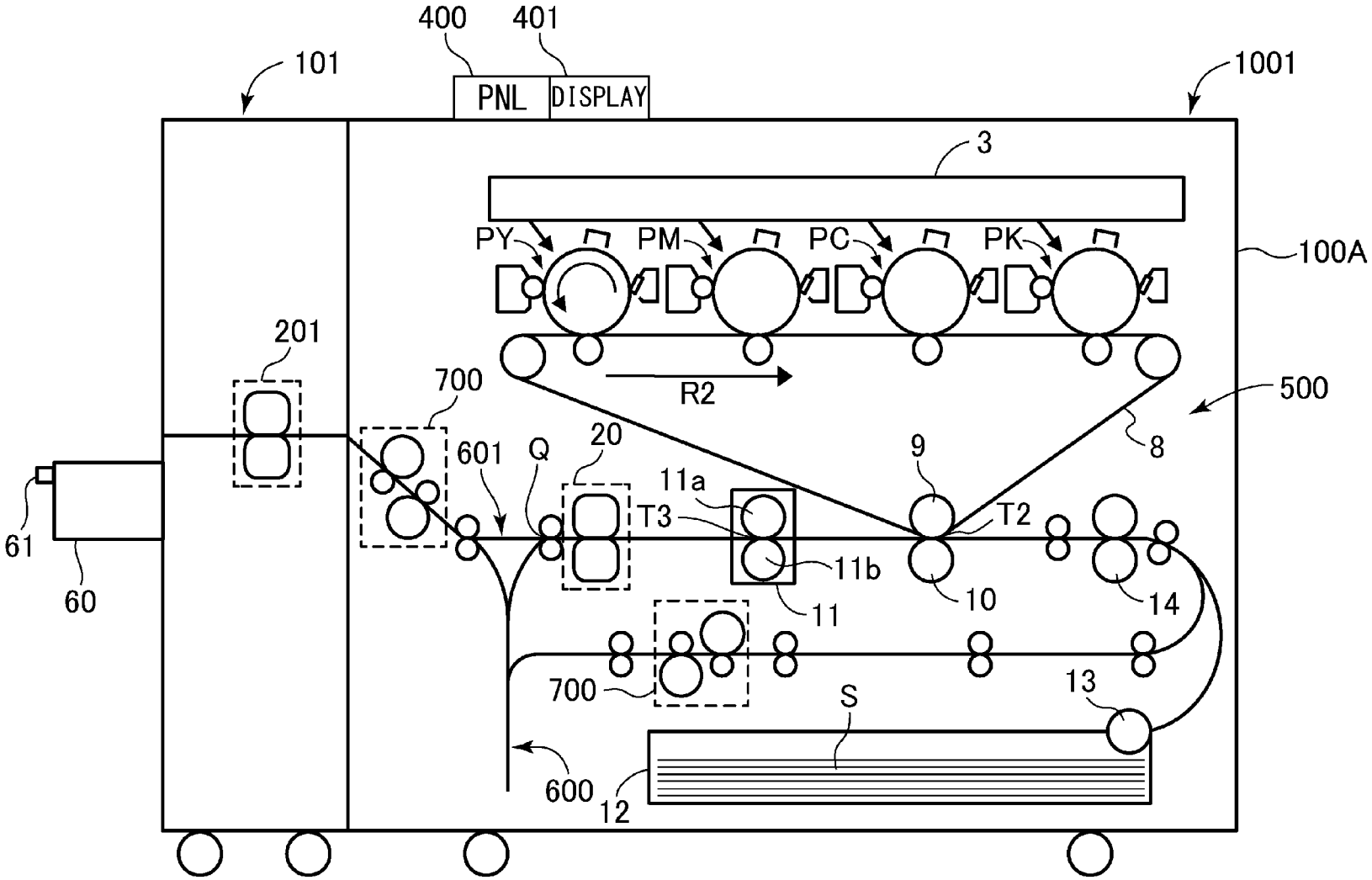

FIG. 6 is a schematic sectional view of an example of image forming apparatus provided with a second uncurling apparatus which is disposed in the two-sided image formation sheet passage.

DESCRIPTION OF THE EMBODIMENTS

<Image Forming Apparatus>

Figure 1:
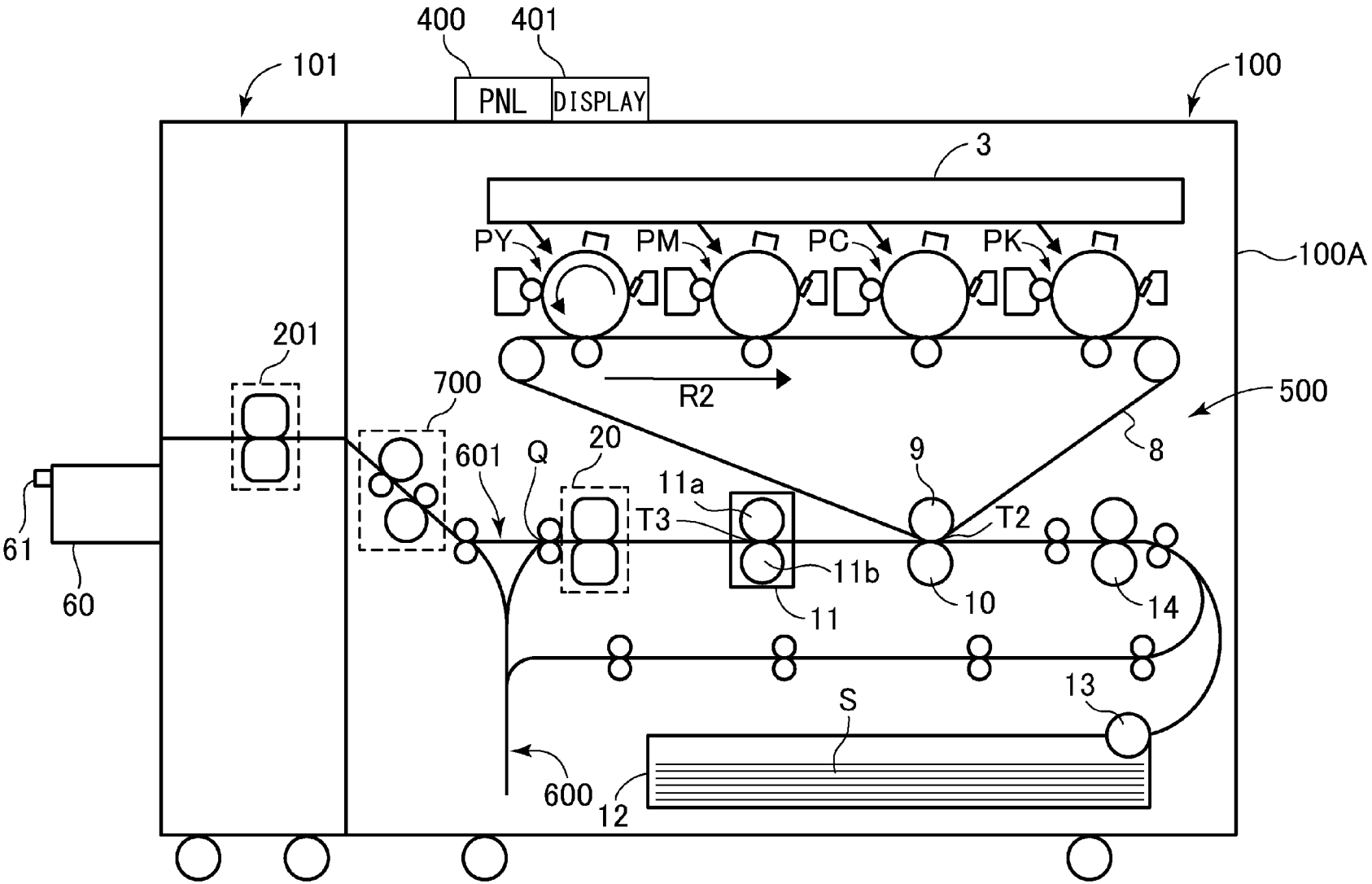
FIG. 1 is a schematic sectional view of the image forming apparatus in the first embodiment of the present invention; it shows showing the structure of the apparatus.
Figure 2:
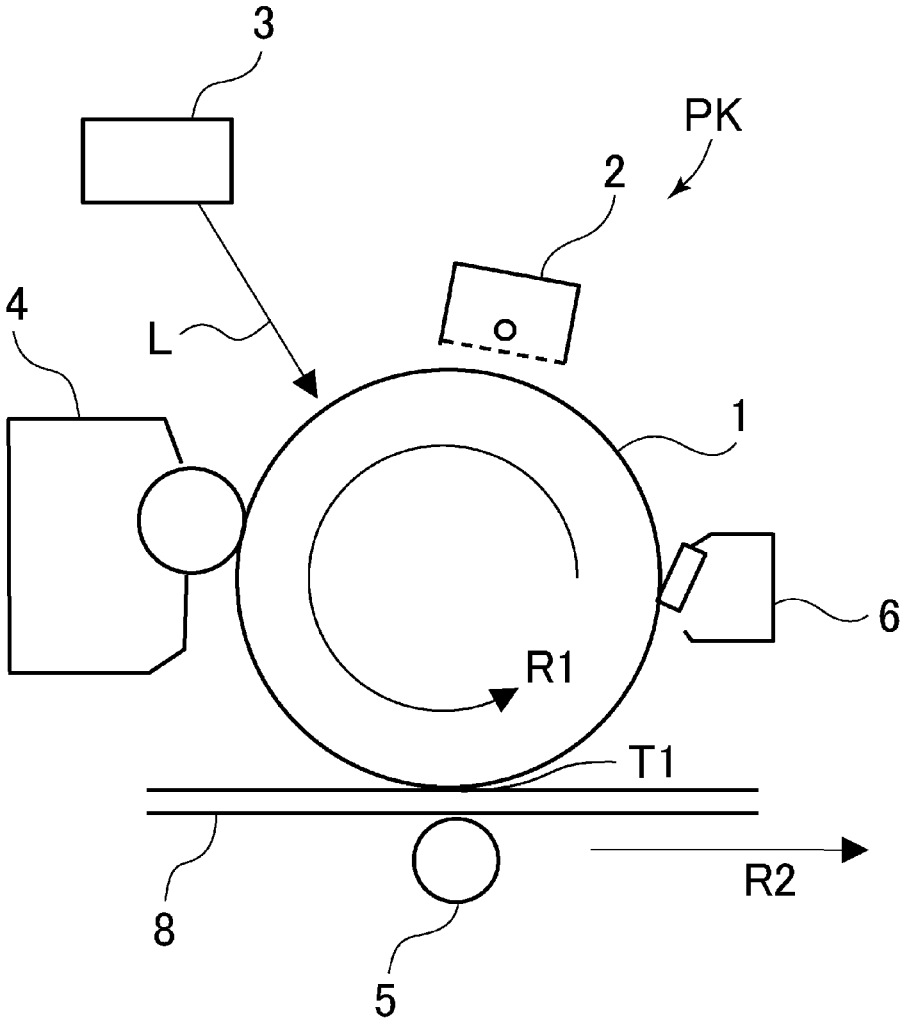
FIG. 2 is a schematic sectional view of the image forming portion of the image forming apparatus in FIG. 1.

To begin with, referring to FIGS. 1 and 2, the structure of the image formation system in this embodiment of the present invention is described. The image formation system shown in FIG. 1 has an image forming apparatus 100 and an external cooling apparatus 101 which is in connection to the downstream side of the image forming apparatus 100 in terms of the sheet conveyance direction.

The image forming apparatus 100 is an electrophotographic full-color printer of the so-called tandem type. It has image forming portions PY, PM, PC, and PK which form yellow, magenta, cyan, and black images, respectively. It forms a toner image on a sheet S of recording medium in response to image formation signals from an external device (unshown) such as an original reading apparatus (unshown) or a personal computer which is in connection to the apparatus main assembly 100A. Various medium can be used. For example, ordinary paper, cardstock, rough paper, embossed paper, coated paper, plastic film, fabric, and the like can be used. In this embodiment, an image formation unit 500 for forming a toner image on a sheet S of recording medium comprises image forming portions PY-PK, a primary transfer roller 5 (FIG. 2), an intermediary transfer belt 8, a belt-backing roller 9, and a secondary transfer roller 10.

Referring to FIG. 1, the image forming portions PY, PM, PC and PK are disposed within the apparatus main assembly 100A, and are aligned in tandem, in the listed order, in the direction parallel to the moving direction of the intermediary transfer belt 8. The image forming apparatus 100 is structured so that the intermediary transfer belt 8 is suspended and tensioned by multiple rollers and runs in the direction indicated by an arrow mark R2. The intermediary transfer belt 8 bears a toner image transferred (primary transfer) onto the belt 8. The secondary transfer roller 10 is positioned so that it opposes the belt-backing roller 9 with the intermediary transfer belt 8 between the two rollers 9 and 10, forming a secondary transferring portion T2 for transferring the toner image on the intermediary transfer belt 8 onto a sheet S of recording medium. The belt-back roller 9 is one of the rollers by which the intermediary transfer belt 8 is suspended and tensioned. The fixing apparatus is disposed on the downstream side of the secondary transferring portion T2, in terms of the recording medium conveyance direction.

In the bottom portion of the image forming apparatus 100, a cassette 12 for holding multiple sheets S of recording medium is disposed. Each sheet S of recording medium in the cassette 12 is conveyed toward a pair of registration rollers 14 by a conveyance roller 13. Thereafter, the registration rollers 14 begin to be rotated to convey the sheet S to the secondary transferring portion T2 with such timing that the sheet S arrives at the secondary transferring portion T2 in synchronism with the arrival of the toner image formed on the intermediary transfer belt 8, as will be described later, at the secondary transferring portion T2. By the way, in this embodiment, the image forming apparatus 100 is provided with only one cassette 12. However, the image forming apparatus 100 may be provided with two or more sheet cassettes so that various sheets of recording medium which are different size, thickness, etc., can be separately stored. In such a case, a sheet S of recording medium is selectively conveyed out of one of the multiple cassettes. Further, the image forming apparatus 100 may be structured so that not only is it possible for a sheet S of recording medium to be conveyed out of the cassette 12, but also, it is possible for a sheet of recording medium to be conveyed from a manual feeding portion (unshown).

The four image forming portions PY, PM, PC, and PK, with which the image forming apparatus 100 is provided, are practically the same in structure although they are different in the color of developer they use. Therefore, only the image forming portion PK is described; the other image forming portions are not separately described.

Referring to FIG. 2, in the image forming portion PK, a cylindrical photosensitive drum 1 is disposed as a photosensitive member. The photosensitive drum 1 is rotationally driven in the direction indicated by an arrow mark R1. The image forming portion PK is also provided with a charging apparatus 2, an exposing apparatus 3, a developing apparatus 4, a primary transfer roller 5, and a cleaning apparatus 6, which are disposed in the adjacencies of the peripheral surface of the photosensitive drum 1, in the listed order.

Next, the process through which a full-color image, for example, is formed by the image forming apparatus 100 is described. First, as an image forming operation is started, the peripheral surface of the photosensitive drum 1 is uniformly charged by the charging apparatus 2. The charging apparatus 2 is a corona charging device, for example, which uniformly charges the peripheral surface of the photosensitive drum 1 to a preset negative potential level (potential level of unexposed point) by irradiating the peripheral surface of the photosensitive drum 1 with charged particles which result from corona discharge. Then, the uniformly charged portion of the peripheral surface of the photosensitive drum 1 is exposed to (scanned by) a beam L of laser light emitted, while being modulated with image formation signals, from the exposing apparatus 3. As a result, an electrostatic latent image, which reflects the image formation signals is effected on the peripheral surface of the photosensitive drum 1. Then, the electrostatic latent image on the peripheral surface of the photosensitive drum 1 is developed into a visible image by the toner (developer) stored in the developing apparatus 4.

The toner image formed on the photosensitive drum 1 is transferred (primary transfer) onto the intermediary transfer belt 8 in the primary transfer portion T1. The intermediary transfer belt 8 is between the peripheral surface of the photosensitive drum 1 and the primary transfer roller 5. The primary transfer roller 5 is disposed so that it opposes the photosensitive drum 1 with the presence of the intermediary transfer belt 8 between the photosensitive drum 1 and primary transfer roller 5. During this process, a primary transfer bias is applied to the primary transfer roller 5. The toner remaining on the peripheral surface of the photosensitive drum 1 after the primary transfer is removed by the cleaning apparatus 6.

The operation described above is sequentially carried out in the yellow, magenta, cyan, and black image forming portions PY-PK. Consequently, four monochromatic toner images, which are different in color, are layered on the intermediary transfer belt 8. Meanwhile, one of the sheets S of recording medium in the cassette 12 is conveyed to the secondary transferring portion T2 in synchronism with the formation of the toner image. In the secondary transferring portion T2, the secondary transfer bias is applied to the secondary transfer roller 10, whereby the four toner images, of which a full-color toner image is formed, on the intermediary transfer belt 8 are transferred together (secondary transfer) onto the sheet of recording medium.

Next, the sheet S of recording medium is conveyed to the fixing apparatus 11. The fixing apparatus 11 has a fixation roller 11*a* and a pressure roller 11*b*. The fixation roller 11*a* is rotated by an unshown motor at a preset peripheral velocity (400 mm/sec, for example) while remaining pressed upon the pressure roller 11*b*. The pressure roller 11*b* is rotatable by the fixation roller 11*a*. The pressure roller 11*b* rotates while remaining pressed upon the fixation roller 11*a*. There is disposed a halogen heater (unshown) within the hollow of the fixation roller 11*a*. The fixation roller 11*a* is increased in surface temperature by the halogen heater. Thus, the fixing apparatus 11 can heat a sheet S of recording medium.

Figure 3:
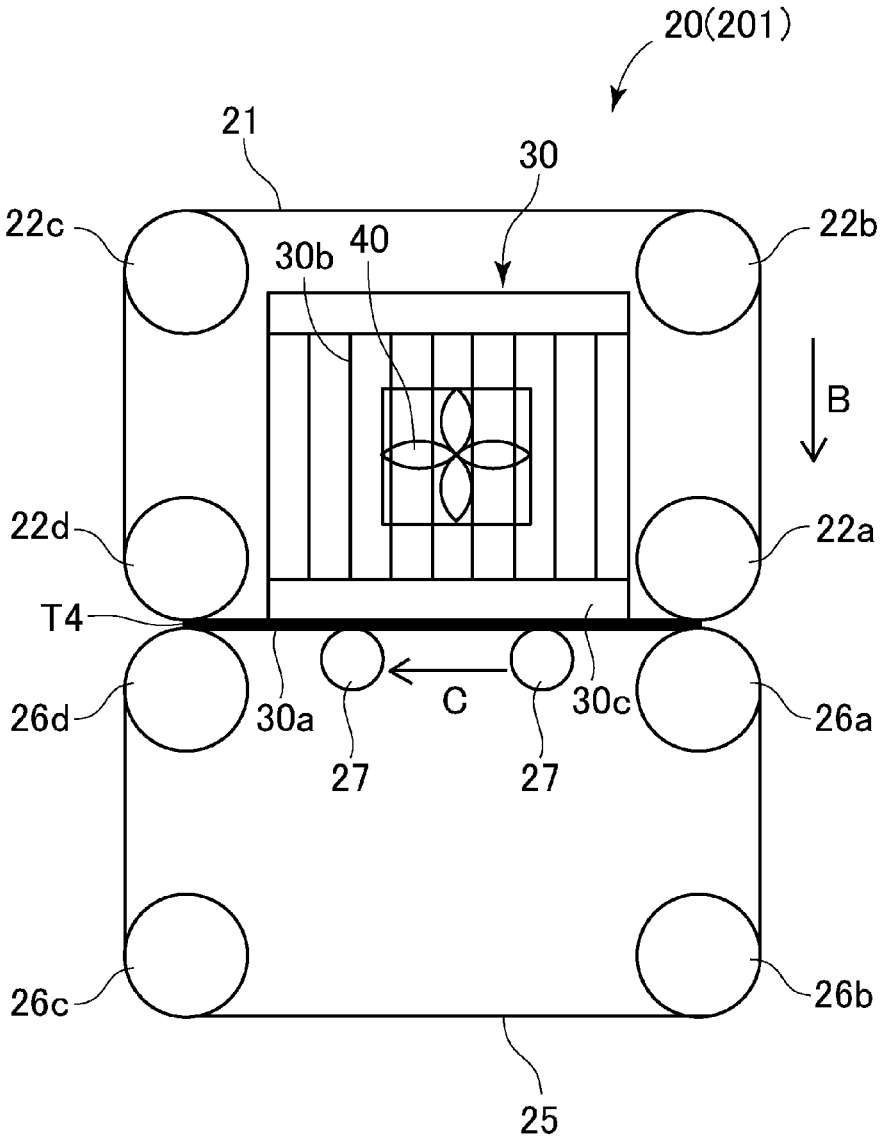
FIG. 3 is a schematic sectional view of the recording medium cooling apparatus in FIG. 1.

The fixing apparatus 11 conveys a sheet S of recording medium, which is bearing a toner image, through a fixation nip T3 formed by the fixation roller 11*a* and pressure roller 11*b*, while keeping the sheet S sandwiched by the two rollers 11*a* and 11*b*. While the sheet S is conveyed through the fixing apparatus 11, the sheet S is heated and pressed. Consequently, the toner image is fixed on the sheet S. That is, the toners on the sheet S are fixed on the sheet S, while being mixed, by the heat and pressure applied thereto. Consequently, a fixed full-color image is realized on the sheet S. This concludes the image formation process comprising the sequential steps described above. After the fixation of the toner image to the sheet S, the sheet S is conveyed to a recording medium cooling apparatus 20, as the first recording medium cooling apparatus. The recording medium cooling apparatus 20 is capable of cooling the sheet S after the passage of the sheet S through the fixing apparatus 11. The recording medium cooling apparatus 20 is described later (FIG. 3).

The image forming apparatus 100 in this embodiment is capable of forming an image on both surfaces of a sheet S of recording medium (two-sided printing mode). In a case when the image forming apparatus 100 is in the mode in which an image is to be formed on only one of the two surface of a sheet S of recording medium, after a sheet S of recording medium is cooled by the recording medium cooling device 20, it is discharged out of the apparatus main assembly 100A through a sheet discharge passage 601. In this embodiment, the sheet discharge passage 601 is provided with an uncurling apparatus 700, which is for uncurling a sheet S of recording medium after the sheet S is conveyed through the recording medium cooling device 20. The details of this setup and uncurling apparatus 700 will be given later.

On the other hand, in a case when the image forming apparatus 100 is in the mode in which a toner image is formed on both surfaces of a sheet S of recording medium (two-sided printing mode), after the cooling of the sheet S by the recording medium cooling device 20, the sheet S is conveyed into the two-sided printing mode sheet passage 600. The two-side printing mode sheet passage 600 branches from the sheet discharge passage 601. It is structured so that when the image forming apparatus 100 is in the two-sided printing mode, that is, the mode in which a toner image is to be formed on, and fixed to, both surfaces (top and bottom surfaces) of a sheet S of recording medium, the sheet S can be turned upside down and conveyed to the image formation unit 500 for the second time after the fixation of a toner image to the top surface of the sheet S. That is, in the two-sided printing mode sheet passage 600, the sheet S is flipped so that the sheet S is turned upside down. After being turned down, the sheet S is conveyed toward the pair of registration rollers 14 for the second time, and is conveyed further by the registration rollers 14 to the secondary transferring portion T2 in such an attitude that the bottom side of the sheet S, that is, the surface of the sheet S on which no image has been formed, faces the intermediary transfer belt 8. In the secondary transferring portion T2, the full-color toner image on the intermediary transfer belt 8 is transferred (secondary transfer) onto the surface of the sheet S of recording medium, which was on the bottom side of the sheet S. Thereafter, the full-color toner image on the sheet S of recording medium is fixed by the fixing apparatus 11. Then, the sheet S is cooled by the recording medium cooling apparatus 20. Then, the cooled sheet S of recording medium is discharged out of the apparatus main assembly 100A through the sheet discharge passage 601.

The image formation system in this embodiment has the external cooling apparatus 101, which is on the downstream side of the image forming apparatus 100 in terms of the sheet conveyance direction. The external cooling apparatus 101 is a peripheral device (which sometimes is referred to as optional device) attachable to the image forming apparatus 100 to increase functions of the image forming apparatus 100. The external cooling apparatus 101 is structured so that it can be connected to the apparatus main assembly 100A of the image forming apparatus 100. The external cooling apparatus 101 cools a sheet S of recording medium as the sheet S is discharged uncurled from the image forming apparatus 100. With this structural arrangement, it is possible to reduce the temperature a sheet S of recording medium as it comes out of the image forming apparatus 100 while remaining higher in temperature than before it is subjected to the fixing process. The external cooling apparatus 101 has a recording medium cooling device 201, as the second cooling apparatus, for cooling a sheet S of recording medium. The external cooling apparatus 101 will be described later (FIG. 3). By the way, two or more external cooling apparatuses 101 may be connected, as peripheral apparatuses, to the image forming apparatus 100. A user can easily increase the cooling capacity of the image formation system by increasing the number of external cooling apparatus 101 connected to the system.

After being cooled by the external cooling apparatus 101, a sheet S of recording medium is discharged from the external cooling apparatus 101, and then, is accumulated in layers in an accumulation unit 60. The accumulation unit 60 is removably attachable to the external cooling apparatus 101 or apparatus main assembly 100A. That is, in a case when the external cooling apparatus 101 is not in connection to the apparatus main assembly 100A, the accumulation unit 60 is directly connected to the apparatus main assembly 100A. However, when it is necessary to attach the external cooling apparatus 101 to the apparatus main assembly 100A, the accumulation unit 60 is removed from the apparatus main assembly 100A by a user and is replaced with the external cooling apparatus 101.

The accumulation unit 60 is attachable to the apparatus main assembly 101 or external cooling apparatus 101 in such a manner that it can be moved upward or downward. Therefore, even if a height of a stack of sheets S of recording medium accumulated in the accumulation unit 60 exceeds a preset value (large enough to fill up accumulation unit 60), the accumulation unit 60 can be moved downward to lower the top of the stack of sheets S below the preset level, so that more sheets S of recording medium can be accumulated in the accumulation unit 60. The accumulation unit 60 is provided with a sheet stack sensing portion 61 for determining whether or not the height of the stack of sheets S in the accumulation unit 60 has reached a preset level. By the way, a finishing unit as a peripheral device, such as a punching unit for making holes through a sheet S of recording medium, a stapling unit for stapling two or more sheets S of recording medium together, or the like, may be disposed between the external cooling apparatus 101 and accumulation unit 60.

<Recording Medium Cooling Device>

At this point in time, referring to FIG. 3, the recording medium cooling device 20 of the apparatus main assembly 100A and the recording medium cooling device 201 of the external cooling apparatus 101, are described. However, the recording medium cooling device 20 and recording medium cooling device 201 may be the same in structure. For example, both may be a cooling device uses a cooling belt. Thus, the recording medium cooling device 20 is described as an example of recording medium cooling device in accordance with the present invention.

The recording medium cooling device 20 has the first belt 21 (third belt) and the second belt 25 (fourth belt). Both the first belt 21 and the second belt 25 are endless. The second belt 25 forms a cooling nip T4 between the second belt 25 and the first belt 21 to cool a sheet of recording medium by conveying the sheet S through the cooling nip T4 while keeping the sheet S sandwiched between the second belt 25 and the first belt 21. Further, the recording medium cooling device 20 has a heat sink 30 for cooling the first belt 21.

Referring to FIG. 3, the first belt 21 is suspended by multiple rollers 22*a*-22*d* in such a manner that the first belt 21 bridges the distance between two adjacent rollers. At least one of the rollers 22*a*-22*d* is rotated by an unshown driving portion, causing the first belt 21 to circularly move in the direction indicated by an arrow mark B in the drawing. On the other hand, the second belt 25 is suspended by multiple rollers 26*a*-26*d* in such a manner that the second belt 25 bridges the distance between two adjacent rollers of the multiple rollers 26*a*-26*d*, and also in such a manner that the second belt 25 is in contact with the first belt 21. Therefore, the second belt 25 is circularly rotated by the rotation of the first belt 21. In this embodiment, by the way, the recording medium cooling device 20 is structured so that the first belt 21 is driven, and the second belt 25 is rotated by the rotation of the first belt 21. However, it may be structured so that the second belt 25 is driven, and the first belt 21 is rotated by the rotation of the second belt 25, or that both the first and second belts 21 and 25 are driven.

After the fixation of a toner image to a sheet S of recording medium, the sheet S is sandwiched between the first and second belt 21 and 25, and is conveyed further (in direction indicated by arrow mark C) by the circular movement of the two belts 21 and 25. During this movement, the sheet S goes through the cooling nip T4 formed by the contact between the first and second belts 21 and 25. In this embodiment, the first belt 21 is cooled by the heat sink 30, which is disposed so that it remains in contact with the inward surface of the first belt 21, in an area which corresponds in position to the cooling nip T4, in order to efficiently cool the sheet S. The sheet S is cooled by the recording medium cooling device 20 while it goes through the cooling nip T4. Since the sheet S is cooled in the cooling nip T4 formed by the combination of the first belt 21 and the second belt 25, the sheet S is efficiently cooled even though it is conveyed only a short distance to be cooled. Further, even if the toners on the sheet S are remain a liquid before the sheet S is conveyed through the cooling nip T4, the toners on the sheet S are made to solidify by the cooling nip T4 and become fixed to the sheet S.

The heat sink 30 is a piece of heat radiating plate (first heat radiating plate, second heat radiating plate) formed of a metallic substance such as aluminum. The heat sink 30 has a heat absorbing portion 30*a* placed in contact with the first belt 21 to rob the first belt 21 of heat. The heat sink 30 also has heat radiating portion 30*b* for radiating heat, and a fin base 30*c* for transferring heat from the heat absorbing portion 30*a* to the heat radiating portion 30*b*. In order to increase the area of contact that the heat radiating portion 30*b* has with ambient air, enabling the heat radiating portion 30*b* to efficiently radiate heat, the heat radiating portion 30*b* is provided with a large number of fins. Further, in order to forcefully cool the heat sink 30 itself, the heat sink 30 is provided with a cooling fan 40 (first cooling fan, second cooling fan) which is capable of blowing air toward the heat sink 30 (more specifically, heat radiating portion 30*b*). The cooling fan 40 is driven by a motor which is supplied with electrical power from a power source, although the motor is not illustrated. The greater the amount of electrical power by which the cooling fan 40 is supplied from a power source (in other words, the greater the power consumption of the motor for the cooling fan 40), the higher the revolution of the motor, and therefore, the amount of airflow from the cooling fan 40 is greater. The greater the airflow of the cooling fan 40, the cooling capacity of the recording medium cooling device 20 is greater.

In this embodiment, a pair of pressure rollers 27 is disposed on the inward side of the loop formed by the second belt 25. The pair of pressure rollers 27 keep the second belt 25 and first belt 21 pressured toward the heat sink 30. With the first belt 21 being kept pressured by the pressure rollers 27 toward the heat sink 30, with the presence of the second belt 25 between the first belt 21 and pressure rollers 27, it is ensured that the first belt 21 remains in contact with the heat sink 30, being thereby efficiently cooled. Further, it is ensured that the first belt 21 and the second belt 25 cool a sheet S of recording medium by conveying the sheet S while keeping the sheet S sandwiched between themselves.

By the way, the recording medium cooling device 20 is structured so that the heat sink 30 is placed in contact with the first belt 21 to cool the first belt 21. However, this embodiment is not intended to limit the present invention in scope in terms of the structure of the recording medium cooling device 20. For example, the recording medium cooling device 20 may be structured so that the heat sink 30 is placed in contact with the second belt 25 to cool the second belt 25, or the recording medium cooling device 20 is provided with a pair of heat sinks 30 which are placed in contact with the first belt 21 and the second belt 25, one for one, to cool both the first belt 21 and the second belt 25. In such a case, the recording medium cooling device 20 may be provided with a pair of cooling fans 40 for blowing air toward the pair of heat sinks 30, one for one. Further, the means for cooling the first belt 21 and/or second belt 25 does not need to be limited to the heat sink 30. For example, the recording medium cooling device 20 may be provided with a belt cooling fan for blowing air toward the belts or a water-based cooling unit to cool the first belt 21 and/or second belt 25. Such a water-based cooling unit may, for example, place pipes, or the like, in contact with the belt, and cooled water may be circulated through the pipes.

Referring to FIG. 1, in this embodiment, in terms of the direction in which a sheet S of recording medium is conveyed, the recording medium cooling device 20 is disposed on the downstream side of the fixing apparatus 11, the uncurling apparatus 70 is disposed on the downstream side of the recording medium cooling device 20, and the recording medium cooling device 201 (external cooling apparatus 101) is disposed on the downstream side of the uncurling apparatus 700. To describe in greater detail, in terms of the recording medium conveyance direction, the recording medium cooling device 20 is disposed on the upstream side of the point (Q in FIG. 1) at which the two-sided printing mode sheet passage 600 branches from the discharge sheet passage 601. On the other hand, the uncurling apparatus 700 is disposed in the discharge sheet passage 601, which is on the downstream side of the branching point Q. Because the uncurling apparatus 700 is disposed in the discharge sheet passage 601, which is on the downstream side of the point Q of branching, a sheet S of recording medium cooled by the recording medium cooling device 20 is put through the uncurling apparatus 700 and then, is discharged out of the apparatus main assembly 100A, regardless of whether the image forming apparatus 100 is in the one-side printing mode or two-sided printing mode. In this embodiment, the external cooling apparatus 101 is connected to the outward side of the apparatus main assembly 100A. Therefore, a sheet S of recording medium is conveyed to the external cooling apparatus 101 which is on the downstream side of the uncurling apparatus 700.

<Uncurling Apparatus>

An example of the uncurling apparatus 700 is shown in parts (a) and (b) of FIG. 4. The uncurling apparatus 700 shown in part (a) of FIG. 4 is provided with a first uncurling portion 701 and a second uncurling portion 702, which are opposite in the direction in which they uncurl a sheet S of recording medium. The two uncurling portions 701 and 702 are disposed in an upstream portion and downstream portion of the discharge sheet passage 601, in terms of the recording medium conveyance direction, with a preset distance between the two uncurling portions 701 and 702. The first uncurling portion 701 is for uncurling a downwardly curled sheet S of recording medium, whereas the second uncurling portion 702 is for uncurling an upwardly curled sheet S of recording medium.

The first uncurling portion 701 conveys a sheet S of recording medium while uncurling the sheet S with its first driving roller 703 (the first roller) and a first follower roller 704 (the second roller). The first driving roller 703 is a metallic roller. The first follower roller 704 is an elastic roller. The first driving roller 703 and second follower roller 704 are placed in contact with each other in such a manner that the first driving roller 703 compresses the first follower roller 704 by a preset amount, forming the first nip T5, which is curved in the sectional view, and through which a sheet S of recording medium is conveyed. As a downwardly curled sheet S of recording medium is conveyed into the first nip T5, the sheet S is subjected to such force that works in the direction to uncurl the sheet S toward the first follower roller 704. Therefore, the sheet S is uncurled.

The second uncurling portion 702 is similar in function as the first uncurling portion 701. That is, it conveys a sheet S of recording medium while uncurling the sheet S with its second driving roller 705 (the third roller) and its second follower roller 706 (the fourth roller). The second driving roller 705 is a metallic roller, whereas the second follower roller 706 is an elastic roller. The second driving roller 705 and second follower roller 706 are placed in contact with each other in such a manner that the second driving roller 705 compresses the second follower roller 706 by a preset amount, forming the second nip T6, which is curved in cross section, and is for conveying a sheet S of recording medium while keeping the sheet S sandwiched by the two rollers 705 and 706. However, the direction of the curvature of the second nip T6 is opposite from that of the first nip T5. As a downwardly curled sheet S of recording medium is conveyed into the second nip T6, the sheet S is subjected to such force that works in the direction to straighten the sheet S toward the second follower roller 706. Thus, the sheet S is uncurled.

By the way, the uncurling apparatus 700 is structured so that it can be adjusted in the amount by which the first driving roller 703 and second driving roller 705 compress the first follower roller 704 and second follower roller 706, respectively. Thus, even in a case when two types of recording medium, which are different in thickness, and therefore, are different in the radius of the curvature in which they curl, are used for a given image forming operation, the uncurling apparatus 700 can be adjusted in the amount by which its first and second driving rollers 703 and 705 compress the first and second follower rollers 704 and 706, respectively, in order to properly uncurl the sheets S.

Further, this embodiment is not intended to limit the application of the present invention to only the uncurling apparatus 700 shown in Part (a) of FIG. 4. For example, the present invention is also applicable to other uncurling apparatuses, such as the uncurling apparatus 700A shown in Part (b) of FIG. 4. The uncurling apparatus 700A has a belt 710 (first rotational member) suspended and tensioned by rollers 711 and 712 and a roller 713 (second rotational member) for forming a nip T7, which is curved in cross-section, and is for conveying a sheet S of recording medium while keeping the sheet S sandwiched between the roller 713 and the belt 710, by being placed in contact with the belt 710 in such a manner that it bends the belt 710.

Referring to FIG. 1, in this embodiment, the uncurling apparatus 700 is disposed between the recording medium cooling device 20 and recording medium cooling device 201, along the sheet passage through which a sheet S of recording medium is conveyed after being conveyed through the fixing apparatus 11. Further, in this embodiment, the recording medium cooling device 20 cools a sheet S of recording medium to a temperature level (in range of 60-70° C., for example), which makes it unlikely for the image on the sheet S to be disturbed, and yet, enables the uncurling apparatus 700 to maintain its uncurling performance. Since it is ensured that, even after the conveyance of a sheet S of recording medium through the recording medium cooling device 20, the temperature of the sheet S remains at a level at which the uncurling apparatus 700 can maintain its uncurling performance, the control apparatus 700 can properly uncurl the sheet S. After being conveyed through the uncurling apparatus 700, the sheet S is cooled to a level (in range 45-55° C., for example) which can prevent the problem that as multiple sheets S are consecutively layered into the accumulation unit 60 and two consecutive sheets are adhered to each other by melted toner. This problem will be described in detail with reference to FIG. 5. By the way, the temperature levels shown in FIG. 5 are examples. They are affected by ambient temperature.

Referring to FIG. 5, after a sheet S of recording medium is conveyed through the fixing apparatus 11, that is, after the fixation of a toner image to the sheet S, the temperature C of the sheet S is in a range of 80-90° C. Therefore, if the sheet S happens to come into contact with guides and rollers, which make up recording medium passages, while it is conveyed, it is possible that the portion of the toner image, which is on the area of the sheet S, by which the sheet S came into contact with the guide and rollers, will be quickly cooled, being thereby made different in gloss from the portion of the toner image, which is on the area of the sheet S, which has not come into contact with the guides and rollers. Moreover, as the sheet S comes out of the fixing apparatus 11, the toner image on the sheet S is still soft, being therefore likely to be scarred. Therefore, in order to prevent the problem that after the sheet S bearing a toner image is conveyed out of the fixing apparatus 11, the toner image is made unsatisfactory, for example, the toner image becomes nonuniform in gloss, and/or is scarred, the sheet S has to be cooled by the recording medium cooling device 20 to reduce the sheet S (toner image) in temperature. Further, in order to prevent the problem that as multiple sheets S are consecutively layered in the accumulation unit 60 and two consecutive sheets S are adhered to each other by the toner (toner image), the temperature of each sheet S has to be reduced to a level E in a range of 45-55° C. However, if the temperature of the sheet S is reduced to a level E in the range of 45-55° C., it becomes difficult to uncurl the sheet S with the use of the uncurling apparatus 700, because the level E is no higher than a level D in the temperature range of 60-70° C. which is effective for the uncurling apparatus 700 to uncurl the sheet S.

Therefore, in this embodiment, the uncurling apparatus 700 is structured so that a sheet S of recording medium is cooled twice, that is, once in the upstream portion of the uncurling apparatus 700, and one more in the downstream portion of the uncurling apparatus 700, as described above. That is, the upstream portion of the uncurling apparatus 700 cools the sheet S to such a level D (60-70° C.) that is low enough to be unlikely to make the toner image on the sheet S unsatisfactory, and yet, is high enough to effectively uncurl the sheet S. In other words, the sheet S is uncurled by the uncurling apparatus 700 after its temperature is reduced to this level D. Then, the uncurled sheet S is cooled by the recording medium cooling device 201 to a temperature level which is no higher than the level E (45-55° C.). Therefore, it is possible to prevent the problem that as multiple sheets S are consecutively accumulated in accumulation unit 60, consecutively conveyed two sheets S are made to adhere to each other by the toner.

As described above, in this embodiment, a sheet S of recording medium is cooled by the recording medium cooling device 20 to a temperature level which is low enough to be unlikely to cause the toner image on the sheet S to become unsatisfactory while the sheet S is conveyed through the uncurling apparatus 700, and yet, is high enough to enable the uncurling apparatus 700 to effectively uncurl the sheet S. Thereafter, the sheet S is uncurled by the uncurling apparatus 700. Then, after the uncurling of the sheet S by the uncurling apparatus 700, the sheet S is cooled for the second time by the recording medium cooling device 201 to a temperature level which is low enough to prevent the toner image on the sheet S from becoming unsatisfactory while two or more sheets S are consecutively accumulated in the accumulation unit 60. Thus, the recording medium cooling device 20 is disposed on the downstream side of the fixing apparatus 11 in terms of the recording medium conveyance direction, and the uncurling apparatus 700 is disposed on the downstream side of the recording medium cooling device 20. Further, the recording medium cooling device 201 is disposed on the downstream side of the uncurling apparatus 700. Therefore, the sheet S can be cooled twice, that is, once before the uncurling of the sheet S by the uncurling apparatus 700, and once more after the uncurling of the sheet S. Therefore, it is possible to satisfactorily cool the sheet S, and also, to satisfactorily uncurl the sheet S.

<Miscellanies>

The image forming apparatus 100 may be structured so that the two-sided printing mode sheet passage 600 is provided with the uncurling apparatus 700 in addition to the uncurling apparatus 700 with which the discharge sheet passage 601 is provided. An image forming apparatus 1001 that has such a structure is shown in FIG. 6. The components of the image forming apparatus 1001, and portions thereof, which are the same in structure as the counterparts of the image forming apparatus 100, are given the same reference characters as those given to counterparts described above. In a case when the uncurling apparatus 700 is disposed in the two-sided printing mode sheet passage 600, a sheet S of recording medium does not remain curled when an image is formed on the second surface (bottom surface) of the sheet S. Therefore, it is assured that an image can be reliably formed on the second surface (bottom surface) of the sheet S. That is, while the sheet S is conveyed through the two-sided printing mode sheet passage 600, the sheet S is cooled by the recording medium cooling device 20 to such a temperature level that is unlikely to make the toner image on the sheet S unsatisfactory while being conveyed, and yet, is high enough to allow the uncurling apparatus 700 to satisfactorily uncurl the sheet S. Therefore, the sheet S is satisfactorily uncurled. After being uncurled, the sheet S is cooled by the recording medium cooling device 201 to a temperature level that can prevent the problem that as multiple sheets S of recording medium are consecutively accumulated into the accumulation unit 60, consecutive two sheets S are made to adhere to each other by the toner.

By the way, in the embodiment described above, the recording medium cooling device 201 and the external cooling apparatus 101 are connected to the apparatus main assembly 100A. However, the preceding embodiment is not intended to limit the present invention in terms of where the recording medium cooling device 201 is positioned. For example, the present invention is also applicable to an image forming apparatus, which is structured so that two or more recording medium cooling devices 20 are disposed in the apparatus main assembly 100A.

Further, in terms of the recording medium conveyance direction, the uncurling apparatus 700 may be positioned on the upstream side of the point (Q in drawing) at which the two-sided printing mode sheet passage 600 branches from the discharge sheet passage 601, and on the downstream side of the recording medium cooling device 20. In such a case, it is unnecessary to place the uncurling apparatus 700 in the two-sided printing mode sheet passage 600 as described above. Further, in terms of the recording medium conveyance direction, the recording medium cooling device 201 and uncurling apparatus 700 may be positioned on the upstream side of the point (Q in FIG. 1) at which two-sided printing mode sheet passage 600 branches from the discharge sheet passage 601, and on the downstream side of the recording medium cooling device 20. Also, in such a case, it is unnecessary to place the uncurling apparatus 700 in the two-sided printing mode sheet passage 600. In this case, however, the sheet S is cooled by the recording medium cooling device 201 while it is conveyed through the two-sided printing mode sheet passage 600, and then, is conveyed to the image formation unit 500 for the second time. Therefore, this setup is undesirable from the standpoint of the thermal efficiency in fixation. As described above, it is desirable that the recording medium cooling device 201 and uncurling apparatus 700 are positioned in the discharge sheet passage 601 which is on the downstream side of the point (Q in FIG. 1) from which the two-sided printing mode sheet passage 600 branches from the discharge sheet passage 601. This setup is advantageous in that it allows a user to fit the image forming apparatus 100 with the recording medium cooling device 201 and uncurling apparatus 700 as necessary.

By the way, the image formation system in the preceding embodiment described above comprised the image forming apparatus 100 having the uncurling apparatus 700 (device), and the external cooling apparatus 101. However, the uncurling apparatus 700 may be provided as an optional apparatus which can be added as necessary to expand the image forming apparatus 100 in function. In such a case, the image forming apparatus 100 has only to be structured so that an external uncurling apparatus having the uncurling apparatus 700 is connectible to the downstream side of the image forming apparatus 100 in terms of the recording medium conveyance direction, and the external cooling apparatus 101 is connectible to the downstream side of the external uncurling apparatus. Even if the image forming apparatus 100 is structured in this manner, a sheet S of recording medium can be satisfactorily uncurled, and it is possible to prevent the consecutively conveyed two sheets S from being adhered to each other by the toner.

Further, the image formation system may be structured so that the recording medium cooling device 20, uncurling apparatus 700, and recording medium cooling device 201 are positioned in the apparatus main assembly 100A. In such a case, the image forming apparatus 100 itself is the image formation system. Even if the image formation system (image forming apparatus 100) is structured in this manner, a sheet S of recording medium can be satisfactorily uncurled, and also, it is possible to prevent the problem that as multiple sheets S of recording medium are consecutively accumulated in the accumulation unit 60, consecutive two sheets S are adhered to each other by the toner.

Effects of Invention

According to the present invention, by positioning an uncurling apparatus between the first and second cooling apparatuses in terms of the recording medium conveyance direction, it is possible to satisfactorily uncurl a sheet of recording medium, and also, to satisfactorily cool the sheet S, with ease.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming system comprising:

an image forming unit configured to form a toner image on a recording material;

a fixing device configured to heat the recording material carrying the toner image formed by said image forming unit to fix the toner image on the recording material;

a first cooling device configured to cool the recording material that has been passed through said fixing device;

a curl reducing device configured to nip and to feed the recording material that has been passed through said first cooling device and to reduce curling of the recording material;

a second cooling device configured to cool the recording material that has been passed through said curl reducing device; and a duplex print feeding path branched from a recording material feeding path of said image forming system at a branch point between said first cooling device and said curl reducing device, said duplex print feeding path reversing a feeding direction of the recording material, on which the toner image is formed on the first side, and refeeding the recording material to said image forming unit, wherein said second cooling device is disposed in a downstream side of the branch point with respect to the feeding direction of the recording material.

2. The image forming system according to claim 1, wherein the duplex print feeding path is provided with another curl reducing device configured to nip and to feed the recording material while reducing the curling of the recording material.

3. The image forming system according to claim 1, wherein said curl reducing device includes a first rotatable member and a second rotatable member contacted with contacting said first rotatable member so as to be cooperative with said first rotatable member to form a curved nip, the curved nip being configured to nip and to feed the recording material.

4. The image forming system according to claim 1, wherein said curl reducing device includes a first rotatable member and a second rotatable member contacting said first rotatable member so as to be cooperative with said first rotatable member to form a first curved nip, the first curved nip being is configured to nip and to feed the recording material, wherein said curl reducing device further includes a third rotatable member provided downstream of said first rotatable member in the recording material feeding direction and a fourth rotatable member contacting said third rotatable member so as to be cooperative with said third rotatable member to form a second curved nip, the second curved nip being configured to nip and to feed the recording material, and wherein the first curved nip and the second curved nip are curved in opposite directions relative to each other.

5. The image forming system according to claim 1, wherein said first cooling device includes (i) a first endless belt configured to contact the recording material to feed the recording material, (ii) a second endless belt cooperative with said first belt to form a first cooling nip configured to nip, to feed, and to cool the recording material, (iii) a first heat radiation plate configured to contact one of said first endless belt and said second endless belt to radiate heat, and (iv) a first cooling fan configured to supply air to said first heat radiation plate, and wherein said second cooling device includes (i) a third endless belt configured to contact the recording material to feed the recording material, (ii) a fourth endless belt cooperative with said third belt to form a second cooling nip configured to nip, to feed, and to cool the recording material, (iii) a second heat radiation plate configured to contact one of said third endless belt and said fourth endless belt to radiate heat, and (iv) a second cooling fan configured to supply air to said second heat radiation plate.

6. The image forming system according to claim 1, further comprising:

an image forming apparatus including said image forming unit and said fixing device; and an external curl reducing apparatus including said curl reducing device, said external curl reducing apparatus being connected to the downstream side of said image forming apparatus with respect to the feeding direction; and an external cooling apparatus including said second cooing device, said external cooling apparatus connected to the downstream side of said external curl reducing apparatus with respect to the feeding direction.

7. The image forming system according to claim 1, further comprising:

an image forming apparatus including said image forming unit, said fixing device, and said first cooling device; and an external cooling apparatus including said second cooling device, wherein said image forming apparatus includes a discharging feeding path disposed downstream of the branch point with respect to the feeding direction, the discharging feeding path being configured to discharge the recording material to an outside of said image forming apparatus.

8. The image forming system according to claim 7, wherein said external cooling apparatus is detachably mountable to an outside of said image forming apparatus so as to cool the recording material discharged from the image forming apparatus.

* * * * *